US006463618B1

(12) United States Patent
Zimmer

(10) Patent No.: US 6,463,618 B1
(45) **Date of Patent: *Oct. 15, 2002**

(54) TOOTHBRUSH COMPRISING IMPROVED MEANS FOR FIXING FRICTION ELEMENTS

(75) Inventor: Bertrand Zimmer, Andolsheim (FR)

(73) Assignee: Sanofi-Synthelabo, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/600,997

(22) PCT Filed: Jan. 21, 1999

(86) PCT No.: PCT/FR99/00122

§ 371 (c)(1),
(2), (4) Date: Sep. 18, 2000

(87) PCT Pub. No.: WO99/37182

PCT Pub. Date: Jul. 29, 1999

(30) Foreign Application Priority Data

Jan. 26, 1998 (FR) ..... 98 00798

(51) Int. Cl.[7] ..... A46B 9/06

(52) U.S. Cl. ..... 15/110; 15/167.1; 15/188; 601/141

(58) Field of Search ..... 15/110, 167.1, 15/186–188; 601/141

(56) References Cited

U.S. PATENT DOCUMENTS

| | | | | | |
|---|---|---|---|---|---|
| 1,251,250 | A | * | 12/1917 | Libby | 15/110 |
| 1,598,224 | A | * | 8/1926 | Van Sant | 15/110 X |
| 2,042,239 | A | * | 5/1936 | Planding | 15/110 |
| 2,196,284 | A | * | 4/1940 | Ackerman | 15/110 X |
| 3,230,562 | A | * | 1/1966 | Birch | 15/110 |
| 3,553,759 | A | | 1/1971 | Kramer et al. | 15/110 |
| 5,242,235 | A | | 9/1993 | Li | 401/268 |
| 6,311,358 | B1 | * | 11/2001 | Soetewey et al. | 15/110 |

FOREIGN PATENT DOCUMENTS

| | | | | | |
|---|---|---|---|---|---|
| CH | 333001 | | * | 3/1959 | 15/167.1 |
| DE | 889587 | | | 7/1953 | |
| EP | 0360766 | A1 | | 3/1990 | |
| FR | 2643241 | A1 | | 8/1990 | |
| GB | 667917 | | * | 3/1952 | 15/188 |
| GB | 2214420 | | * | 9/1989 | 15/167.1 |

* cited by examiner

*Primary Examiner*—Mark Spisich
(74) *Attorney, Agent, or Firm*—Young & Thompson

(57) ABSTRACT

A toothbrush, of the type in which a brush head is equipped with flexible friction rods which include a lower anchoring foot by fastening the rods to a principal body of the head, the anchoring foot of at least some of the rods is received in an anchoring hole passing through the principal body in such a way that upper and lower ends of the anchoring foot are arranged above and below the upper and lower faces, respectively, of the principal body, an upper end of an anchoring foot is connected to a lower end by a bridge of material which extends outside the anchoring hole and, at the lower and upper ends of the anchoring foot, the bridge of material bears against the lower and upper faces, respectively, of the principal body in order to fasten the rods to the head.

10 Claims, 1 Drawing Sheet

FIG.1
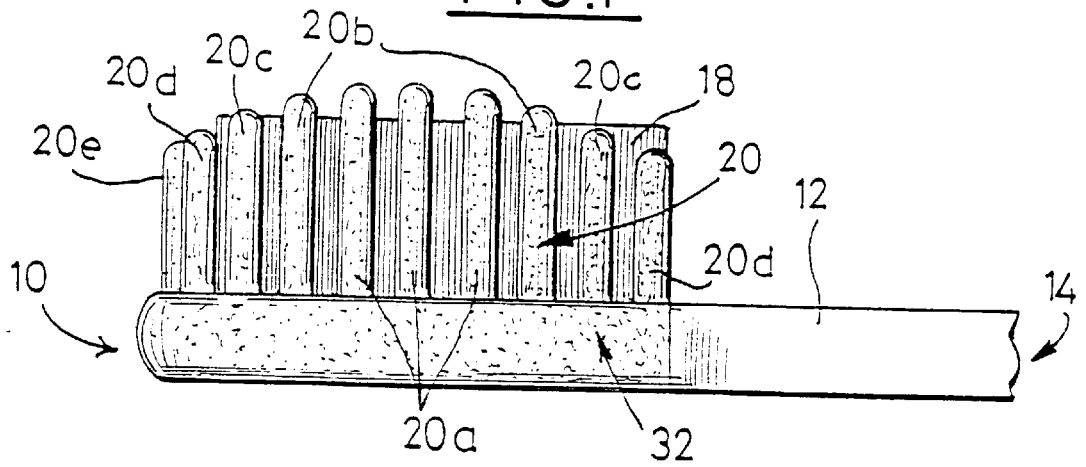
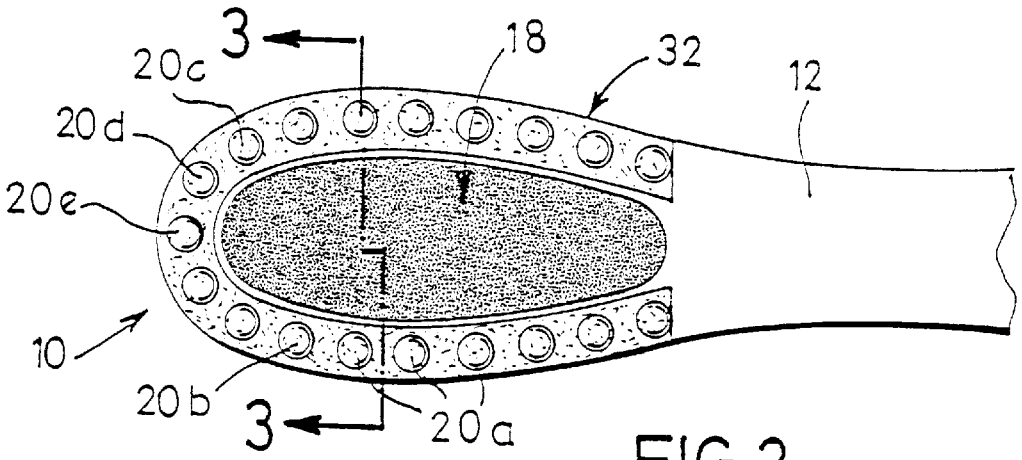
FIG.2
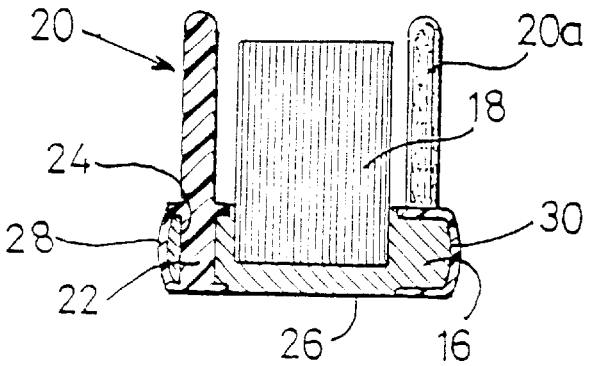
FIG.3

TOOTHBRUSH COMPRISING IMPROVED MEANS FOR FIXING FRICTION ELEMENTS

BACKGROUND OF THE INVENTION

The invention relates to a toothbrush including improved means for fastening the friction elements.

The invention relates more particularly to a toothbrush of the type in which a brush head is equipped with flexible friction elements of general elongate shape, such as, for example, brushing filaments, which include a lower anchoring foot by means of which they are fastened to a principal body of the head.

DESCRIPTION OF THE RELATED ART

Different techniques are known for fastening the friction elements to the principal body.

The friction elements may, for example, be grouped together in bunches or tufts, folded in two and fixed in receptacles made in the upper face of the principal body with the aid of metallic or plastic inserts. This technique, which is reliable, is nevertheless relatively complex to implement. It is, moreover, unsuitable for friction elements which have a relatively large diameter such as, for example, gum-massaging rods, and which it is thus difficult to fold in two.

It is also known to fasten the friction elements by embedding their lower end in the principal body. However, it is then necessary to monitor compatibility of the materials of the body and of the friction elements in terms of their implementation temperatures and in terms of their adhesion to the interface. This results in a restricted selection of materials, which does not always make it possible to comply with other constraints.

SUMMARY OF THE INVENTION

The object of the invention is therefore to propose a new design for fastening the friction elements to the principal body of the head which permits easy and inexpensive implementation, without being restricted in the choice of materials but at the same time guaranteeing satisfactory behaviour of the fastening over time.

To this end, the invention proposes a toothbrush of the type described above, characterized in that the anchoring foot of at least some of the friction elements is received in an anchoring hole passing through the principal body in such a way that upper and lower ends of the anchoring foot are arranged above and below the upper and lower faces, respectively, of the principal body, in that an upper end of an anchoring foot is connected to a lower end by means of a bridge of material which extends outside the anchoring hole and in that, at the lower and upper ends of the anchoring foot, the bridge of material bears against the lower and upper faces, respectively, of the principal body in order to fasten the friction element to the head.

According to further characteristics of the invention:

the bridge of material extends outside the principal body;

the bridge of material extends between the lower and upper ends of one and the same anchoring foot;

the bridges of material of several friction elements are produced together as a single component;

the friction elements include rods made from elastomer materials;

the rods made from elastomer material are produced by moulding and the bridges of material are produced together with the rods;

the principal body has substantially the shape of a plate, the rods made from elastomer material are arranged along an outer lateral edge of the principal body and the linking bridges of the rods form a continuous protective bead made from elastomer material around the outer lateral edge of the principal body;

the protective bead is formed in a hollowed-out impression made in the principal body so that the bead is flush with the level of the outer faces of the principal body;

the lower face of the principal body of the head is covered by a web of elastomer material which is produced as a single component together with the rods;

the rods are produced from elastomeric silicone.

BRIEF DESCRIPTION OF THE DRAWINGS

Further characteristics and advantages of the invention will become apparent on reading the following detailed description, which may be understood with reference to the appended drawings, in which:

FIG. 1 is a side view of the head of a toothbrush in accordance with the teachings of the invention, seen from the side;

FIG. 2 is a top view of the head of the toothbrush in FIG. 1; and

FIG. 3 is a transverse sectional view along the line 3—3 in FIG. 2.

DESCRIPTION OF THE PREFERRED EMBODIMENTS

The figures show the head 10 of a toothbrush placed at a front longitudinal end 12 of a handle 14 of the brush.

The head 10 includes a principal body 16, for example made from a thermoplastic material such as a polyamide. The principal body 16 has substantially a plate shape extending in a longitudinal plane and carries a bunch of parallel filaments 18 which extend perpendicular to the plane of the principal body. These filaments may, for example, be made from a thermoplastic material of the polyamide type or polyethylene type, but they may also consist of natural bristles.

In the example illustrated in the figures, the filaments 18 all have the same height, i.e. they all extend over the same distance above the upper face of the principal body 16. The principal body 16 has outer lateral edges 30, the contour of which may be substantially similar to that of a racket, and it includes two substantially parallel upper and lower faces. As the principal body 16 in this case has a relatively elongate shape, the lateral edges 30 of the head 10 have only a relatively shallow curve, except, of course, at their front end, which is substantially in the shape of an arc of a circle.

As may be seen, in particular, in FIG. 2, the filaments 18 are grouped together substantially in the centre of the upper face of the head, the edges of the latter being occupied by rods 20 made from elastomer material which extend parallel to the filaments 18. The rods 20, uniformly distributed along the lateral edges of the upper face of the principal body 16, are, for example, made in the form of cylinders with a diameter substantially between 1 and 2.5 mm and they have a rounded upper end in the form of a spherical dome. The rods 20 are preferably made from elastomeric silicone, but it is also possible to produce them in a vulcanized rubbery material or with the aid of a thermoplastic elastomer material.

The rods 20 thus form, on each side of the central bunch of filaments 18, two longitudinal rows placed close to the corresponding edge of the head 10. The front end of the head 10 also carries rods 20.

The filaments 18 and the rods 20 form flexible friction elements which are intended to come into contact with the teeth and gums, respectively.

In the exemplary embodiment illustrated, the rods 20 do not all have the same height and, in particular, they have a variable height in comparison with the height of the adjacent elements 18.

Thus, the head 10 includes, in each of the two rows which flank the filaments 18 longitudinally, three rods 20*a*, the height of which is substantially greater than that of the adjacent filaments 18. The rods 20*a* which are the tallest are preferably arranged longitudinally in the centre of each row and their height does not exceed that of the filaments by more than 25%.

When a row is viewed from the side, in a direction perpendicular to the longitudinal direction of the brush and to the direction of the filaments, this group of three rods 20*a* is flanked on each side by rods 20*b*, the height of which is between that of the filaments 18 and that of the tallest rods 20*a*.

The rods 20*b* are themselves flanked by rods 20*c*, the height of which is substantially equal to that of the filaments 18.

Finally, the overall assembly formed by the rods 20*a*, 20*b*, 20*c* is itself flanked by rods 20*d*, the height of which is less than that of the adjacent filaments 18.

When the head 10 is viewed from the side, the upper ends of the rods 20 placed on one and the same longitudinal side of the head 10 are thus arranged in a substantially symmetrical curve, the curvature of which faces downwards.

Moreover, the toothbrush illustrated in the figures includes a rod 20*e* placed at the front end of the head 10, in the longitudinal plane of symmetry of the brush, the length of the rod being less than that of the rods 20*d*.

In all cases, the length of the shortest rods 20 will preferably be more than 10% less than that of the adjacent filaments 18.

Naturally, the total number of rods 20 may be less than or greater than that in the exemplary embodiment illustrated in the figures and, similarly, the curve joining the tops of the ends of the rods may have a greater or lesser curvature, this curve, however, being above the upper end of the filaments 18 in the centre of the head and below the longitudinal ends of the head.

This arrangement results in effective brushing of the teeth and massaging of the gums.

Indeed, when the toothbrush is applied to the lateral surfaces of the teeth, inside or outside, one of the two rows of rods is in contact, essentially by means of the tall rods 20*a*, 20*b*, with the gum, whilst the filaments 18 are applied to the teeth themselves.

However, when the brush is applied to the masticatory face of the teeth, the longitudinal direction of the brush then 15 being substantially parallel to the direction of alignment of the teeth, the tallest rods 20*a*, 20*b* are located on either side of the teeth and thus do not interfere with the action of the filaments 18 which may thus clean the surface of the teeth and penetrate into the interdental spaces.

Moreover, the shortest rods and, in particular, those 20*d* and 20*e* placed at the front end of the head 10, tend to limit squashing of the filaments 18 against the teeth.

In accordance with the teaching of the invention, provision is made for improved means for fastening at least some of the friction elements.

Indeed, as may be seen, in particular, in FIG. 3, the rods 20 include an anchoring foot 22 which extends inside a cylindrical anchoring hole 24 passing through the principal body 16.

Each anchoring hole 24 opens out in both the upper and lower faces of the principal body so that the lower end of the anchoring foot 22 of the rod extends below the lower face 26 of the principal body 16.

The lower end of the anchoring foot 22 which extends below the lower face 26 has a cross section which is larger than that of the anchoring hole 24 so as to prevent any removal of the rod 20 upwards.

According to a particularly advantageous aspect of the invention, the rods 20 are produced by moulding and provision is made for a bridge of material 28, made as a single component with each rod 20, to join the lower and upper ends an of the anchoring foot 22 of the rod 20, following the outer lateral edge 30 of the principal body 16 around the outside.

At its junctions with the ends of the anchoring foot 22, the bridge of material 28 bears against the upper and lower faces of the principal body 16. Thus, forming an integral part of the rod 20, the bridge of material fastens the rod 20 perfectly in its anchoring hole 24.

This characteristic is particularly advantageous when the rod 20 is made from elastomeric silicone of food-grade quality. Indeed, with such a material, it is impossible to produce a reliable chemical link between the rod 20 and the principal body 16. In point of fact, the use of such a material is particularly advantageous owing, in particular, to its very satisfactory acceptance by the user and its very good resistance to wear and deformation.

Similarly, it is impossible to use conventional techniques of fastening by means of metallic inserts with rods of relatively large diameter.

Preferably, all the rods 20 are produced simultaneously by moulding and they are produced as a single component, connected together by means of their respective linking bridges 28.

All the linking bridges 28 therefore form a continuous bead 32 made from elastomer material which completely encircles the outer lateral edge 30 of the principal body 16 and whose purpose is to dampen impacts between the principal body 16 and either the teeth or the gum.

Provision is preferably made for the bead 32 thus formed to extend into hollowed-out impressions formed in the upper and lower faces and in the lateral edges 30 of the principal body 16 in such a way that the outer surface of the bead 32 is in line with the external faces of the principal body 16 and of the handle 14.

In a variant, provision may also be made for a web made from elastomer material, covering the lower face 26 of the principal body 16, to be produced at the same time as the rods 20.

This new design for fastening a friction element is thus particularly advantageous in terms of implementation cost and reliability. It also makes it possible, without significant extra cost, to produce a coating for the edges 30 of the head using a flexible material.

The invention has been described above for the fastening of elastomeric rods of relatively large diameter. However, it may also be implemented for fastening all types of friction elements to the head of a toothbrush.

What is claimed is:

1. Toothbrush having a brush head (10) equipped with rods (20) and bristles (18) and which includes a lower anchoring foot (22) fastening the rods to a principal body (16) of the head (10), characterized in that the anchoring foot (22) of at least some of the rods is received in an anchoring hole (24) passing through the principal body in such a way that upper and lower ends of the anchoring foot (22) are arranged above and below the upper and lower faces (26), respectively, of the principal body (16), in that an upper end of an anchoring foot (22) is connected to a lower end by means of a bridge of material (28) which extends outside the anchoring hole (24) and in that, at the lower and upper ends of the anchoring foot (24), the bridge of material (28) bears against the lower and upper faces (26), respectively, of the principal body (16) in order to fasten the rods to the head (10).

2. Toothbrush according to claim 1, characterized in that the bridge of material (28) extends outside the principal body (16).

3. Toothbrush according to claim 1, characterized in that the bridge of material (28) extends between the lower and upper ends of one and the same anchoring foot (22).

4. Toothbrush according to claim 1, characterized in that the bridges of material (28) of the rods are produced together as a single component.

5. Toothbrush according to claim 4, characterized in that the rods (20) are made from elastomer material.

6. Toothbrush according to claim 5, characterized in that the rods (20) made from elastomer material are produced by moulding and in that the bridges of material (28) are produced together with the rods (20).

7. Toothbrush according to claim 6, characterized in that the principal body (16) has substantially the shape of a plate, in that the rods (20) made from elastomer material are arranged along an outer lateral edge (30) of the principal body (16) and in that the bridges of material (28) of the rods (20) are linked to form a continuous protective bead (32) made from elastomer material around the outer lateral edge (30) of the principal body (16).

8. Toothbrush according to claim 7, characterized in that the protective bead (32) is formed in a hollowed-out impression made in the principal body (16) so that the bead (32) is flush with the level of the outer faces of the principal body (16).

9. Toothbrush according to claim 6, characterized in that the lower face (26) of the principal body (16) of the head (10) is covered by a web of elastomer material which is produced as a single component together with the rods (20).

10. Toothbrush according to claim 5, characterized in that the rods (20) are produced from elastomeric silicone.

* * * * *